US005633561A

United States Patent [19]

Barker

[11] Patent Number: 5,633,561

[45] Date of Patent: May 27, 1997

[54] CONDUCTOR ARRAY FOR A FLAT PANEL DISPLAY

[75] Inventor: Dean Barker, Chandler, Ariz.

[73] Assignee: Motorola, Schaumburg, Ill.

[21] Appl. No.: 623,034

[22] Filed: Mar. 28, 1996

[51] Int. Cl.[6] ..... H01J 1/02

[52] U.S. Cl. ..... 313/497; 313/306; 313/308; 313/309; 313/336; 313/351; 313/332

[58] Field of Search ..... 313/306, 308, 313/309, 336, 351, 331, 338, 497, 332; 315/169.4; 345/55, 75

[56] References Cited

U.S. PATENT DOCUMENTS

| | | | |
|---|---|---|---|
| 4,763,187 | 8/1988 | Biberian | 313/308 X |
| 5,142,184 | 8/1992 | Kane | 313/336 X |
| 5,157,309 | 10/1992 | Parker et al. | 313/309 X |
| 5,216,324 | 6/1993 | Curtin | 313/495 |
| 5,283,500 | 2/1994 | Kochanski | 313/306 X |
| 5,502,347 | 3/1996 | Dworsky et al. | 313/351 |
| 5,528,098 | 6/1996 | Dworsky et al. | 313/351 |
| 5,534,744 | 7/1996 | Leroux et al. | 313/497 X |
| 5,543,691 | 8/1996 | Palevsky et al. | 313/308 X |

*Primary Examiner*—Ashok Patel
*Attorney, Agent, or Firm*—Eugene A. Parsons

[57] ABSTRACT

A conductor array (100), for addressing a plurality of field emitters (130), including a plurality of cathode conductors (106, 108, 110) having conductive cathode connectors (126), a plurality of gate conductors (104) having a plurality of conductive gate connectors (116, 118, 120), and a plurality of fusible links (134, 138), which are located at a plurality of overlapping regions (103) of the cathode conductors (106, 108, 110) and the gate conductors (104) and which can be electrically severed to isolate electrical shorts existing at the overlapping regions (103).

9 Claims, 3 Drawing Sheets

300

100

200

CONDUCTOR ARRAY FOR A FLAT PANEL DISPLAY

FIELD OF THE INVENTION

The present invention relates, in general, to the area of flat panel displays and more particularly to the patterning of the gate and cathode conductors which permits easy removal of gate-to-cathode electrical shorts and which significantly reduces loss of display functionality due to electrical shorting between the gate and cathode conductors.

BACKGROUND OF THE INVENTION

Flat panel displays, such as field emission displays, are well known in the art. A field emission display employs an array of field emission devices (FEDs). An FED is activated by applying the appropriate electric field to extract electrons which, in a field emission display, are directed toward a light-emitting material on a face plate. An example of a FED is given in U.S. Pat. No. 5,142,184 issued to Robert C. Kane on Aug. 25, 1992. Typically, an array of conductor material is employed for selectively addressing the array of FEDs in the field emission display. The conductor array typically includes at least two types of electrodes: the cathode conductor and the gate conductor which, when the appropriate voltage is applied to each electrode, provide an electric field of predetermined field strength. Generally, the cathode conductor and the gate conductor formed at right angles to each other to facilitate the selective addressing of the electron emitting structures. The cathode conductors are typically electrically isolated from the gate conductors by a non-conducting dielectric layer. During the formation of the displays, however, defects, such as pinholes, can form in the dielectric layer which result in electrical shorts between the cathode conductor and gate conductor at the site of the defect. A single cathode-to-gate short can effectively ruin an field emission display. These shorts are difficult to locate and difficult, or impossible, to remove.

Accordingly, there exists a need for a conductor array for a flat panel display which significantly reduces the formation of cathode-to-gate electrical shorting and from which cathode-to-gate electrical shorts can be easily removed with minimal loss of display functionality.

BRIEF DESCRIPTION OF THE DRAWINGS

Referring to the drawings.

DESCRIPTION OF THE PREFERRED EMBODIMENTS

Figure 1:
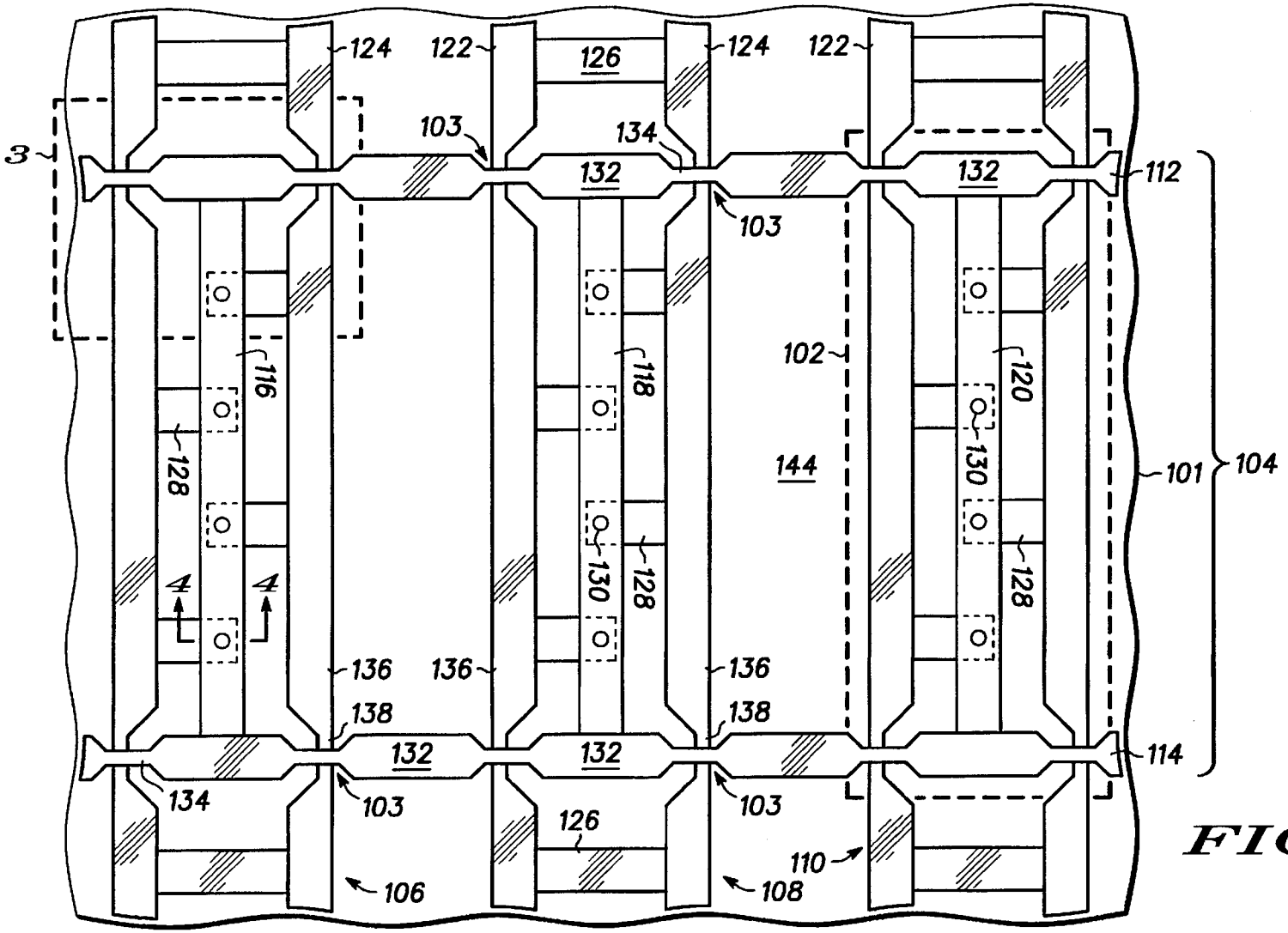
FIG. 1 is a top plan view of a preferred embodiment of a conductor array for a flat panel display in accordance with the present invention.

Referring now to FIG. 1, there is depicted a top plan view of the preferred embodiment of a conductor array 100 for a flat panel display in accordance with the present invention. Conductor array 100 includes a plurality of cathode conductors 106, 108, 110 and a gate conductor 104. Cathode conductors 106, 108, 110 and gate conductor 104 are made of a conductive material, such as molybdenum, which is deposited and patterned by methods known in the art, such as physical vapor deposition. A substrate 101 is provided and includes a layer of glass or silicon. Substrate 101 may further include other layers, such as adhesion layers, being deposited on the layer of glass or silicon. Cathode conductors 106, 108, 110 are formed on substrate 101. Each of cathode conductors 106, 108, 110 includes a first redundant conductive member 122 and a second redundant conductive member 124, which is substantially parallel to first redundant conductive member 122. Redundant conductive members 122, 124 provide redundant current paths that allow electrical current to flow around isolated electrical shorts, as will be described in detail below. Cathode conductors 106, 108, 110 further include a plurality of conductive cathode connectors 126, which are also made of a conductive material and which extend between first redundant conductive member 122 and second redundant conductive member 124 to provide a current path between first redundant conductive member 122 and second redundant conductive member 124. A dielectric layer 144 is formed on cathode conductors 106, 108, 110, using deposition methods known to those skilled in the art. Thereafter, gate conductor 104 is formed on dielectric layer 144. Dielectric layer 144 includes a layer of a non-conductive material, such as silicon dioxide, and electrically isolates cathode conductors 106, 108, 110 from gate conductor 104. Gate conductor 104 includes a first redundant conductive member 112 and a second redundant conductive member 114, which is substantially parallel to first redundant conductive member 112. Redundant conductive members 112, 114 provide redundant current paths that allow current to flow around isolated electrical shorts, as will be described in detail below. A plurality of conductive gate connectors 116, 118, 120, which are also made of a conductive material, extend between first redundant conductive member 112 and second redundant conductive member 114 to provide a current path between first redundant conductive member 112 and second redundant conductive member 114. Gate conductor 104 overlies cathode conductors 106, 108, 110 at substantially right angles to provide a plurality of sub pixels 102, which include the intersections of gate conductor 104 with cathode conductors 106, 108, 110, and one of which is enclosed by a dashed box in FIG. 1. In this particular embodiment, conductive cathode connectors 126 are disposed outside sub pixels 102. This configuration reduces the amount of overlapping between gate conductor 104 and cathode conductors 106, 108, 110, thereby reducing the probability of creating an electrical short between conductive cathode connectors 126 and conductive gate connectors 116, 118, 120. If conductor array 100 is utilized to form an array of sub pixels 102, so that more than one row of sub pixels 102 is included in the array, conductive cathode connectors 126 may be disposed one per sub pixel 102, or fewer than one per sub pixel 102, but at least one conductive cathode connector 126 is included in each of cathode conductors 106, 108, 110. A plurality of ballast resistors 128 are disposed within sub pixels 102 and are formed from a resistive material. Ballast resistors 128 extend between cathode conductors 106, 108, 110 and conductive gate connectors 116, 118, 120, respectively. Ballast resistors 128 also underlie a plurality of field emitters 130, which are also formed within the plurality of sub pixels 102. One or more field emitters 130 may be disposed at each of the locations where conductive gate connectors 116, 118, 120 overlaps ballast resistors 128. Ballast resistors 128 have a high electrical resistance on the order of several megaohms, which provides uniform emission and which limits electrical current through electrical shorts which may form between conductive gate connectors 116, 118, 120 and ballast resistors 128. By operably coupling a voltage source (not shown) to cathode conductors 106, 108, 110, and another voltage source (not shown) to gate conductor 104 to provide a potential difference between cathode conductors 106, 108, and/or 110, and gate conductor 104, an electric field having a predetermined field strength is provided at selected field emitters 130. Field emitters 130 include electron-emitting structures which are electron-emissive at low voltages. Such structures, the materials from which they are formed, and the conditions required to control their emission characteristics, are known to one skilled in the art, and include structures such as the well known Spindt tip. In the preferred embodiment of FIG. 1, conductor array 100 further includes a plurality of fusible links 134, 138, which are disposed at, or proximate to, the locations of conductor array 100 where there exists a tendency to develop an electrical short between gate conductor 104 and cathode conductors 106, 108, 110. In this particular embodiment, gate conductor 104 overlaps cathode conductors 106, 108, 110 at a plurality of overlapping regions 103, each of which includes an underlying segment of cathode conductor 106, 108, or 110, and an overlying segment of gate conductor 104. Overlapping regions 103 are possible sites for the formation of gate-to-cathode shorts. If, for example, a pinhole is formed during processing in dielectric layer 144 between the conductive materials of one of the overlapping regions 103, an undesired current path is created at overlapping region 103, thereby effectively ruining the device. To solve this problem, fusible links 134, 138 are formed in the conductive material of overlapping regions 103. Fusible links 134 include tapered portions of redundant conductive members 112, 114 of gate conductor 104 and are positioned between a plurality of wide portions 132; fusible links 138 include tapered portions of redundant conductive members 122, 124 of cathode conductors 106, 108, 110 and are positioned between a plurality of wide portions 136. In other embodiments of the present invention, only fusible links 134 or fusible links 138 are included. Also, other embodiments of the present invention may include fusible links in ballast resistors 128, at the portion between field emitters 130 and redundant conductive member 122, 124. In the preferred embodiment of FIG. 1 fusible links 134, 138 are tapered to a width of about 5 micrometers, while wide portions 132, 136 have a width of about 15 micrometers. The widths of fusible links 134, 138 and wide portions 132, 136 are selected so that, when a predetermined current is introduced into cathode conductor 106, 108, or 110 having a gate-to-cathode electrical short, only those fusible links 134, 138, which are located at, or proximate to, the short, will be destroyed, thereby electrically isolating the short from the rest of conductor array 100. The value of this blow-out current is limited, at the low end, by the current-carrying requirements for normal operation of conductor array 100; the blow-out current is limited, at the high end, by the requirement that only fusible links 134, 138 will blow out, while wide portions 132, 136 remain intact during the blow-out procedure. The blow-out current is experimentally determined and, in this particular embodiment, has a value of about 30 milliamperes. When a current is applied to conductor array 100 having an electrical short, the arrangement of redundant cathode and gate conductors, and of cathode connectors and gate connectors, provides twice as much current density at fusible links 134, 138, which are located at, or near, an electrical short, as the current density at all other fusible links 134, 138. When the blow-out current is applied to conductor array 100, the increased current density at fusible links 134, 138 which are located at, or near, an electrical short, is sufficient to sever fusible links 134, 138, while the lower current density at fusible links 134, 138, which are not at, or near, an electrical short is not sufficient to sever fusible links 134, 138. In this manner, fusible links 134, 138, which are located at, or near, electrical shorts are selectively severed to isolate the electrical shorts thereby retaining the functionality of conductor array 100. This procedure for eliminating gate-to-cathode electrical shorts can be easily performed by utilizing common electrical testing equipment. After conductor array 100 has been fabricated, electrical testing equipment (supplied by manufacturers such as Teradyne or Keithley) is utilized to check for the existence of electrical shorts and other electrical defects. The electrical resistance in cathode conductors 106, 108, 110 and gate conductor 104 is measured by a standard ohm-meter. It is known that the resistance between 50 gate conductors shorted together and 50 cathode conductors shorted together, is greater than or equal to about one megaohm when no electrical shorts exist between the cathode conductors and the gate conductors; if, for this 50×50 configuration, the resistance is appreciably lower than one megaohm, at least one electrical short is determined to exit. This measurement does not precisely locate the electrical short(s), but, as will be made evident below, precise location of the electrical short(s) is not required in order to eliminate it/them and restore functionality of the conductor array. A conductor array in a VGA display, for example, includes 480 gate conductors and 1920 cathode conductors; so, the testing, and blow-out, of 50×50 matrices provides a corrective procedure which can be performed within a reasonable period of time (approximately under a minute), given the large number of shorts that may need to be isolated. When a low resistance is measured, the predetermined blow-out current, described in detail above, is applied with the electrical testing equipment, thereby electrically isolating the short(s). The resistance is measured once more to verify a high resistance and the successful elimination of the short (s).

Figure 2:
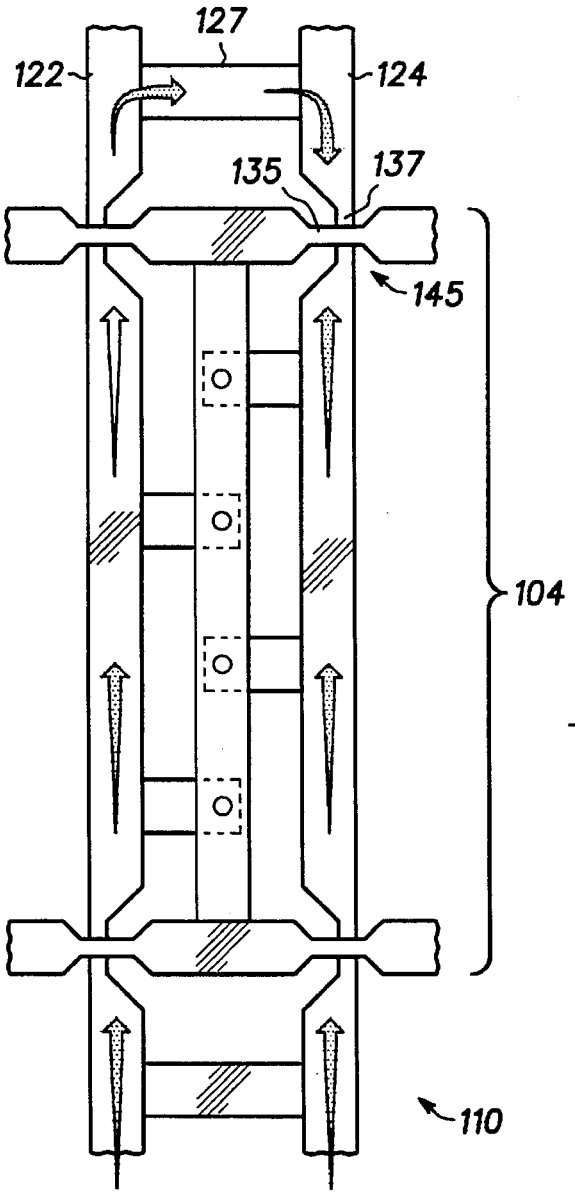
FIG. 2 is a top plan view of a portion of the conductor array of FIG. 1.

Referring now to FIG. 2, there is schematically depicted the current flow in cathode conductor 110 when an electrical short exists between cathode conductor 110 and gate conductor 104 at an overlapping region 145, which includes a fusible link 135 in gate conductor 104 and a fusible link 137 in cathode conductor 110. If an electrical current, represented by upward-pointing arrows at the bottom of FIG. 2, is caused to flow up cathode conductor 110 (gate conductor 104 is grounded), the electrical current in first and second redundant conductive members 122, 124 will have equal current densities, until the current in second redundant conductive member 124 reaches overlapping region 145, at which location the current is caused to flow, through the electrical short, to gate conductor 104. The current in first redundant conductive member 122 seeks the path of least resistance; so, it flows up first redundant conductive member 122 of cathode conductor 110, across a conductive cathode connector 127, and then down second redundant conductive member 124 toward the electrical short. In this manner, the current density in fusible link 137 and in fusible link 135 is twice the current density at other fusible links 134, 138 in cathode conductor 110 and gate conductor 104, thereby selectively severing fusible links 135, 137 at overlapping region 145.

Referring once more to FIG. 1, in some instances, a short will exist at each of two or more overlapping regions 103 of a single sub pixel 102. In this particular situation, when these shorts are isolated, either the cathode conductor or the gate conductor defining the sub pixel 102 having the two or more shorts, is rendered dysfunctional. However, conductor array 100 will, in substantially all other shorting configurations, otherwise be rendered functional by the above short-isolation procedure, thereby providing a major improvement over the prior art. After the electrical isolation of the gate-to-cathode short(s), an operating current applied to conductor array 100 is able to flow around those fusible links 134, 138 which have been destroyed, by utilizing the current paths provided by conductive cathode connectors 126 and by conductive gate connectors 116, 118, 120, and by exploiting the redundancy, or alternate current paths, provided by redundant conductive members 112, 114, 122, 124. In this manner, field emitters 130 are accessed by the operating current, and the predetermined electric field can be established at field emitters 130, thereby providing their functionality after the correction of electrical shorts. The tapered width of fusible links 134, 138 provides the additional benefit of decreasing the total overlapping area of conductive material at overlapping regions 103, thereby decreasing the probability of forming electrical shorts. The preferred embodiment thus provides fusible links 134 in cathode conductors 106, 108, 110 as well as fusible links 138 in gate conductor 104, rather than just in cathode conductors 106, 108, 110 or gate conductor 104, although these later configurations, included in other embodiments of the present invention, are also capable of undergoing the procedure for isolating electrical shorts, as described above.

Figure 3:
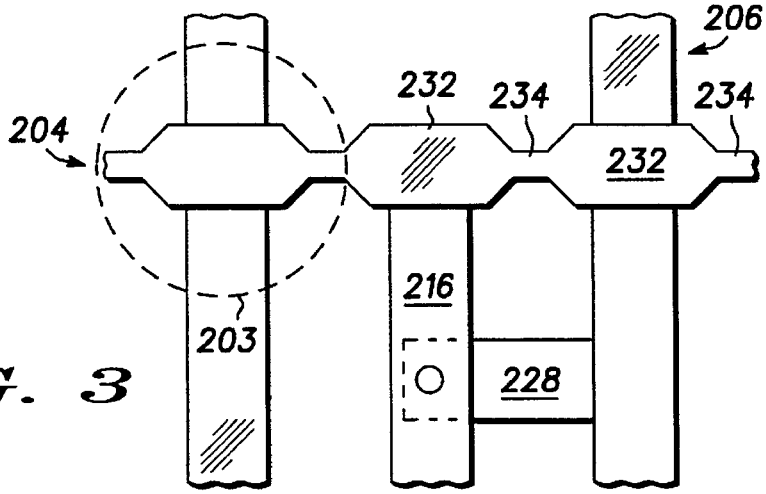
FIG. 3 is a top plan view of a portion of another embodiment of a conductor array for a flat panel display in accordance with the present invention.

Referring now to FIG. 3, there is depicted an enlarged view of a portion, analogous to the portion enclosed within a dashed box in FIG. 1, of another embodiment of a conductor array 200 for addressing a plurality of field emitters, in accordance with the present invention. Elements of the embodiment of FIG. 3, which are the same as those of FIG. 1, are similarly numbered and begin with a "2". Conductor array 200 includes a plurality of fusible links 234, which are disposed within a plurality of intersections 203. At each of the plurality of intersections 203, a wide portion 232 is positioned between two fusible links 234. When an electrical short exists between a gate conductor 204 and a cathode conductor 206 at intersection 203, a blow-out current is applied to conductor array 200, and fusible links 234 on both sides of the short will be severed, thereby isolating the short.

Figure 4:
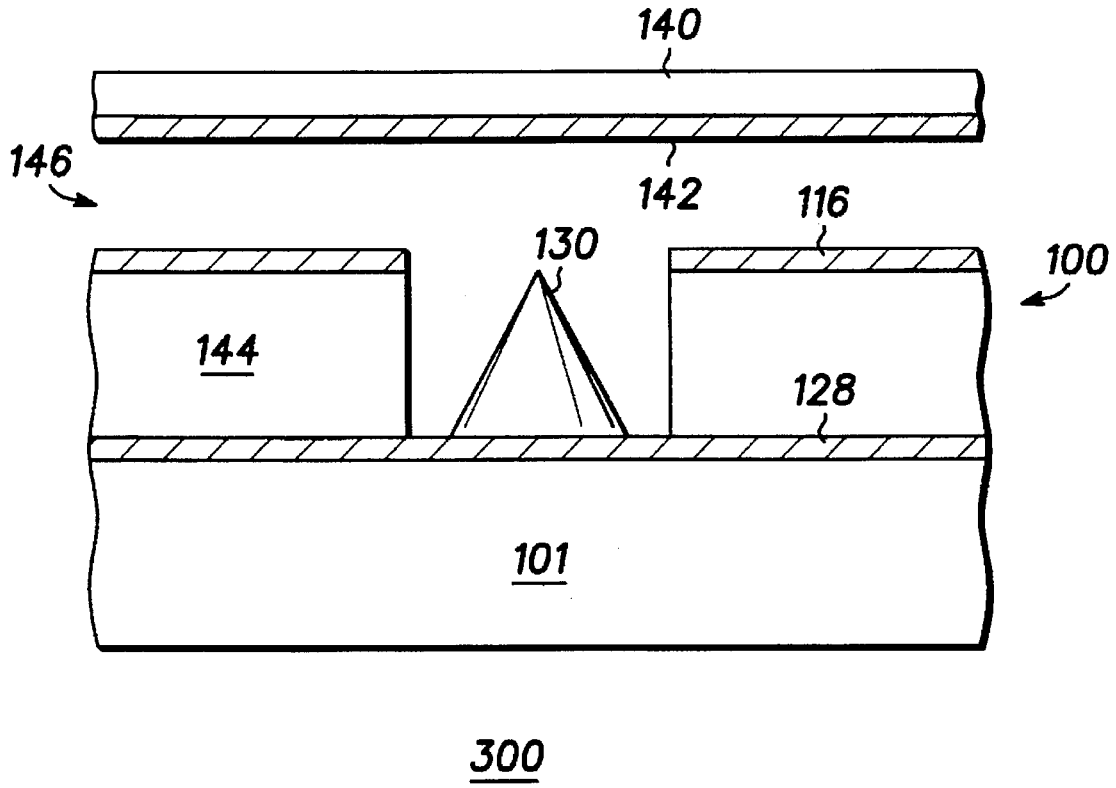
FIG. 4 is an enlarged, cross-sectional view of a portion of the structure of FIG. 1 illustrating further elements to provide a field emission display in accordance with the present invention.

Referring now to FIG. 4 there is depicted a cross-sectional view taken at the line 4—4 of FIG. 1 and illustrates a portion of a field emission display 300 which includes conductor array 100 (FIG. 1). Field emission display 300 further includes a face plate 140 which is substantially optically transparent and which has a layer 142 of cathodoluminescent material deposited thereon, designed to emit light when it receives electrons emitted by field emitters 130. Face plate 140 is positioned distally in fixed space relationship with respect to conductor array 100 and field emitters 130. Face plate 140 also includes an optically transparent conductive layer which is disposed beneath layer 142 and to which an externally provided voltage source is coupled so that an accelerating potential can be provided at face plate 140 to accelerate electrons toward layer 142. Field emission display 300 also includes an evacuated chamber 146 defined by face plate 140 and conductor array 100. During the operation of field emission display 300, a first voltage is applied to cathode conductors 106, 108, 110, and a second voltage is applied to gate conductor 104 so that a predetermined electric field is established at field emitters 130 providing electron emission from selected field emitters 130. The emitted electrons traverse evacuated chamber 146 as they are accelerated toward face plate 140. In other embodiments of the present invention, more than one field emitter 130 is provided at each of the overlapping portions of ballast resistors 128 and conductive gate connectors 116, 118, 120. Sub pixels 102 in field emission display 300 are utilized to activate layer 142, which has portions that emit red, blue, or green light. A group of three sub pixels 102 comprises a pixel; a plurality of pixels are included in field emission display 300. Within a given pixel, one of sub pixels 102 opposes a portion of layer 142 which emits red light; another of sub pixels 102 opposes a portion of layer 142 which emits blue light; and the third of sub pixels 102 opposes a portion of layer 142 which emits green light, thereby providing a color display. In other embodiments, all portions of layer 142 emit the same type of light, thereby providing a monochromatic display. When the electrical short isolation procedure, described with reference to FIG. 1, is performed to test conductor array 100 of field emission display 300, many benefits are realized, such as reduced costs, increased yield, and enhanced manufacturability, thereby providing a low cost display.

I claim:

1. A conductor array for addressing a plurality of field emitters, the conductor array comprising:

a cathode conductor being disposed on a major surface of a substrate and having a first redundant conductive member, a second redundant conductive member being substantially parallel to the first redundant conductive member, and a conductive cathode connector extending between the first redundant conductive member and the second redundant conductive member, the conductive cathode connector having first and second opposed ends, the first opposed end of the conductive cathode connector being electrically connected to the first redundant conductive member of the cathode conductor, the second opposed end of the conductive cathode connector being electrically connected to the second redundant conductive member of the cathode conductor;

a gate conductor being disposed on a dielectric layer being formed on the cathode conductor, the gate conductor overlying the cathode conductor thereby forming an intersection defining a sub pixel, the gate conductor having a first redundant conductive member and a second redundant conductive member being substantially parallel to the first redundant conductive member thereby defining a plurality of overlapping regions including an underlying segment of the cathode conductor and an overlying segment of the gate conductor, the gate conductor further including a conductive gate connector having first and second opposed ends, the first opposed end of the conductive gate connector being electrically connected to the first redundant conductive member of the gate conductor, the second opposed end of the conductive gate connector being electrically connected to the second redundant conductive member of the gate conductor; and a plurality of fusible links disposed one each at the plurality of overlapping regions thereby defining a plurality of wide portions, wherein the plurality of field emitters are formed within the sub pixel and are electrically coupled to the cathode conductor and to the gate conductor so that a predetermined electric field is formed at the plurality of field emitters to provide emission.

2. A conductor array as claimed in claim 1 further including a ballast resistor electrically connected to and extending between the cathode conductor and at least one of the plurality of field emitters.

3. A conductor array as claimed in claim 1 wherein the conductive cathode connector is disposed outside the sub pixel.

4. A conductor array as claimed in claim 1 wherein the conductive gate connector is disposed within the sub pixel.

5. A conductor array as claimed in claim 1 wherein the plurality of field emitters are disposed at the conductive gate connector.

6. A conductor array as claimed in claim 1 wherein each of the plurality of fusible links has a width of 5 micrometers and each of the plurality of wide portions has a width of 15 micrometers.

7. A field emission display comprising:

a substrate having a major surface;

a plurality of cathode conductors being disposed on the major surface of the substrate, each of the plurality of cathode conductors having a first redundant conductive member, a second redundant conductive member being substantially parallel to the first redundant conductive member, and a conductive cathode connector extending between the first redundant conductive member and the second redundant conductive member, the conductive cathode connector having first and second opposed ends, the first opposed end of the conductive cathode connector being electrically connected to the first redundant conductive member, the second opposed end of the conductive cathode connector being electrically connected to the second redundant conductive member;

a dielectric layer formed on the plurality of cathode conductors;

a plurality of gate conductors being formed on the dielectric layer and overlying the plurality of cathode conductors thereby providing a plurality of intersections defining a plurality of sub pixels, each of the plurality of gate conductors having a first redundant conductive member and a second redundant conductive member being substantially parallel to the first redundant conductive member thereby defining a plurality of overlapping regions including an underlying segment of one of the plurality of cathode conductors and an overlying segment of one of the plurality of gate conductors, the plurality of gate conductors including a plurality of conductive gate connectors disposed at least one each at the plurality of gate conductors, each of the plurality of conductive gate connectors having first and second opposed ends, the first opposed end of the gate connectors being electrically connected to the first redundant conductive member of one of the plurality of gate conductors, the second opposed end of the gate connectors being electrically connected to the second redundant conductive member of the same one of the plurality of gate conductors;

a plurality of fusible links disposed one each at the plurality of overlapping regions;

a plurality of field emitters being disposed at least one each within the plurality of sub pixels, the at least one of the plurality of field emitters being electrically coupled to the cathode conductor and to the gate conductor of the sub pixel in which it is disposed; and a face plate having a major surface opposing the plurality of field emitters and defining an evacuated chamber there between.

8. A field emission display as claimed in claim 7 wherein the plurality of conductive gate connectors is disposed one each within the plurality of sub pixels, the plurality of field emitters being disposed at least one each within the plurality of conductive gate connectors, the field emission display further including a plurality of ballast resistors having first and second opposed ends and being disposed at least one each within the plurality of sub pixels, the first opposed end of the ballast resistors being connected to the cathode conductor of the sub pixel and the second opposed end of the ballast resistors underlying the conductive gate connector at the location of the at least one of the plurality of field emitters thereby providing electrical coupling between the plurality of field emitters and both the plurality of cathode conductors and the plurality of gate conductors.

9. A field emission display as claimed in claim 7 further including a layer of cathodoluminescent material being disposed on the major surface of the face plate and being designed to emit light when the layer of cathodoluminescent material receives electrons emitted by the plurality of field emitters.

* * * * *